US005096408A

United States Patent [19]

Bielfeldt

[11] Patent Number: 5,096,408

[45] Date of Patent: Mar. 17, 1992

[54] CONTINUOUSLY OPERATING PRESS

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 671,403

[22] Filed: Mar. 19, 1991

[30] Foreign Application Priority Data

Mar. 30, 1990 [DE] Fed. Rep. of Germany ..... 4010308

[51] Int. Cl.[5] ..... B30B 5/04

[52] U.S. Cl. ..... 425/371; 100/93 RP; 156/583.5

[58] Field of Search ..... 100/93 RP, 153, 154; 156/555, 583.5; 425/371

[56] References Cited

U.S. PATENT DOCUMENTS

| | | | |
|---|---|---|---|
| 4,417,866 | 11/1983 | Sitzler | 425/371 |
| 4,485,733 | 12/1984 | Held | 425/371 |
| 4,771,683 | 9/1988 | Schermutzki | 156/583.5 |
| 4,807,525 | 2/1989 | deBrock | 425/371 |
| 4,921,418 | 5/1990 | Bielfeldt | 156/583.5 |
| 4,923,384 | 5/1990 | Gerhardt | 156/583.5 |
| 4,997,514 | 3/1991 | Bielfeldt | 156/583.5 |

FOREIGN PATENT DOCUMENTS 2343427 3/1975 Fed. Rep. of Germany .

*Primary Examiner*—Jay H. Woo
*Assistant Examiner*—C. Scott Bushey
*Attorney, Agent, or Firm*—Foley & Lardner

[57] ABSTRACT

This invention discloses a continuously operating press having a pressing table, a pressing ram and flexible endless steel strips which are driven around the pressing table and pressing ram, respectively, and which draw the material to be pressed through the press. The press also has rolling bars which are disposed between the steel strips, and the pressing table and pressing ram, respectively. The rolling bars provide support to the steel strips and roll on roll platens which are attached to heated platens. The roll platens have surfaces which are heat treated and which have a precision ground finish and a Brinell hardness of 250.

8 Claims, 2 Drawing Sheets

CONTINUOUSLY OPERATING PRESS

BACKGROUND OF THE INVENTION

1. Field of the Invention

The invention relates to a continuously operating press for the production of chipboards, fiberboards and plywood boards.

2. Description of the Related Art

In the case of presses operating in the high-pressure range, development is moving toward exerting higher surface pressures on the material being pressed. This is especially true if the purpose is to produce highly compressed chipboards, where the pressures range from 55 bar and above. With rolling support provided by means of rolling bars, these high pressures increasingly result in "Hertzian stresses" on the surfaces of the heated platens. On the other hand, the heated platens have to be produced from a weldable steel material, because it is necessary to weld in inserts appropriately at the deflection channels and generally seals at the outer end faces. Weldable steels have, however, only a limited carbon content, which normally results in a surface hardness of about 180 to 190 Brinell. Additional surface hardness treatments merely produce an increased Brinell hardness in the range from 200 to 220 Brinell. With the large dimensions of the heated platens (for example 2.5 m×10 to 15 m long), there is a thermal distortion which occurs during the course of the heat treatment for increasing hardness. Thus, there is a risk in such heat treatment processes that, if the heated platens are not rolled with a level surface area, the relatively thin hardened layer is removed in the subsequent grinding machining processes, thereby penetrating and exposing layers of lesser Brinell hardness.

In the practical operation of continuous presses using such heated platens, the above stated condition has the effect that considerable wear occurs on the heated platen's supporting surfaces after operating hours of about 3000 to 6000 hours. This wear does not result so much in a general removal of the supporting surface, but instead, grooves (with peak and valley) are formed transversely to the through-running direction of the material to be pressed. These grooves correspond approximately to the spacing of the rolling bars. This results in increased running noises, and with increasing wear, produces critical vibrations in the overall press system. At a surface pressure of 50 bar, the "Hertzian stress" with use of rolling bars (in the diameter range around 20 mm) lies at about 200 Brinell. Thus, with the slightest disturbances, for example, in a regular and uniform lubrication distribution system, the system operates unreliably as a result of which the wear phenomena described above occur.

It is of disadvantageous significance in this case that the orthogonal running of the rolling bars in the pressing area is not ensured and that it is possible for the rolling bars to run into each other and even be destroyed.

SUMMARY OF THE INVENTION

The invention is based on the object of further developing a continuously operating press of the above-mentioned type in such a way that the disadvantages noted above no longer occur, the wearing of the heated platens is avoided and reliable orthogonal rolling of the rolling bars is ensured.

This objective is achieved by a continuously operating press which has a press table and a pressing ram with an adjustable gap defined therebetween. The press also has driving and deflecting drums which drive endless flexible steel strips around the pressing ram and pressing table respectively. The steel strips are supported by rolling bars disposed between the pressing table and pressing ram, with the axes of the rolling bars transverse to the movement of the steel strips. The rolling bars roll on roll platens which have a thickness in a range of 7 mm to 22 mm and a Brinell hardness of 250. The roll platens have heat treated precision ground finished surfaces and are attached to heated platens which are in turn attached to the pressing table and pressing ram.

The design according to the invention of the continuously operating press makes it possible to make roll platens from a steel having a higher carbon content, and which have a greater resistance to thermal distortion caused by heat treatment, and a Brinell hardness of 250 and above.

According to the invention, the roll platens are heat-treated on both sides or may be hardened-throughout. The surface is treated, for example, by precision grinding on both sides to minimize the rolling resistance of the rolling bars. The increased surface hardness of these roll platens provides an ideal rolling support for the rolling bars. Since no wear occurs on the roll platen surfaces, as in the case of support directly against the heated platens, a higher life expectancy of the rolling bars themselves is also likely. The perfectly satisfactory rolling of the rolling bars on the roll platen also helps to achieve an exact running control of the steel strip. The effect of the rolling bars on the roll platen also helps to achieve an exact running control of the steel strip.

Due to the effect of the hydraulic compressive forces produced by the centrally arranged multipot cylinders during the control for setting a chip-board of parallel thickness, a topographically increased surface peak pressures in the range of up to about 250 bar may occur. Only with these hardened roll platens is the press system able to accommodate these increased pressures and continue to function properly and produce an advantageous cost-effective service life. With regard to quality, service life, producibility and installability, a thickness of 7 to 23 mm is regarded as being advantageous for the roll platens. However, for optimization of requirements, a thickness of 12 to 18 mm is recommended.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The press according to the invention is defined in detail using an illustrative embodiment and with reference to the drawing, in which.

DETAILED DESCRIPTION OF THE PREFERRED EMBODIMENTS

Figure 1:
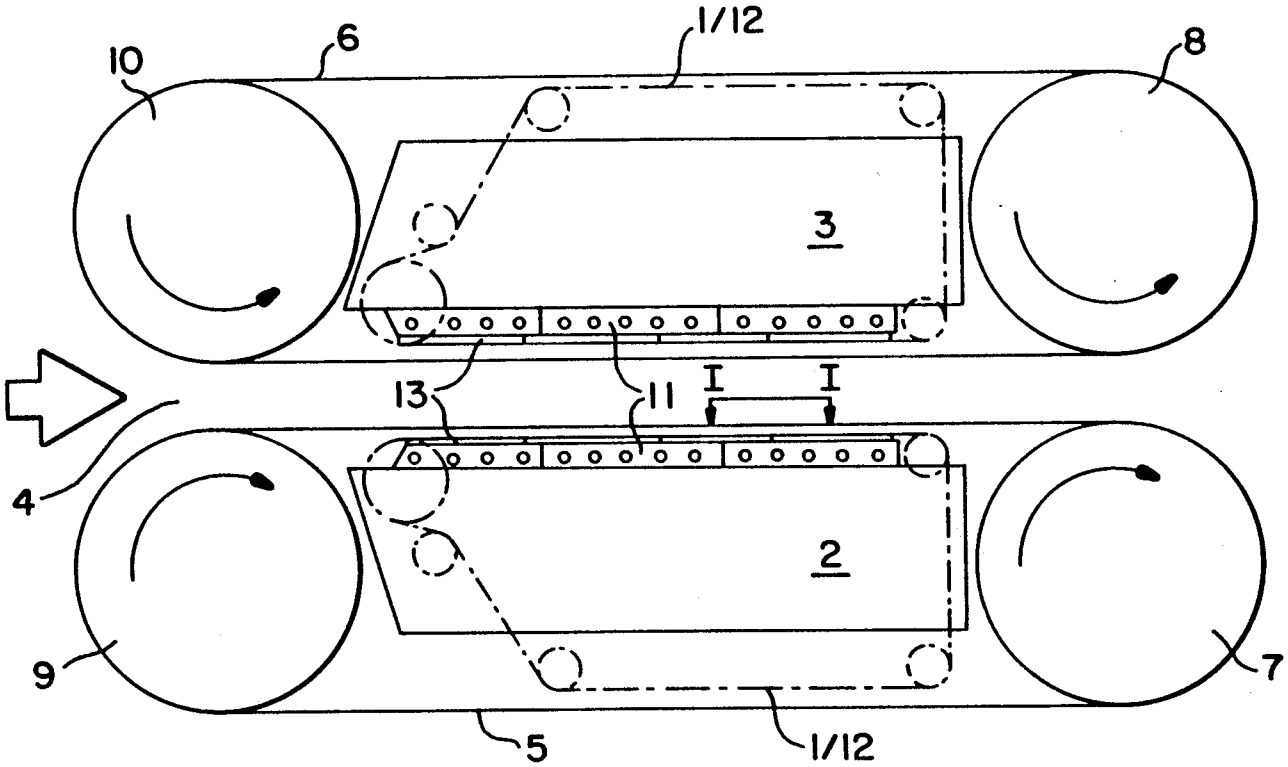
FIG. 1 shows in diagrammatic representation the continuously operating press in side view.

According to FIG. 1, the continuously operating press consists of a pressing table 2, a movable pressing ram 3 and tie bars (not shown) which connect them. For setting the pressing gap 4, the pressing ram 3 is moved up and down by hydraulic piston-cylinder arrangements (not shown) and arrested in the chosen position. Steel strips 5 and 6 are led around pressing table 2 and pressing ram 3, respectively, via driving drums 7 and 8 and deflecting drums 9 and 10. To reduce friction between the heated platens 11, which are attached to the pressing table 2 and pressing ram 3, and the circulating steel strips 5 and 6, there is provided, in each case, a rotating roller bar carpet formed by rolling bars 1. The rolling bars 1, the axes of which extend transversely to the strip through-running direction, are locked together on the two longitudinal sides of the press in guide chains 12 of a predetermined pitch and are passed through the press by the steel strips. The rolling bars 1 roll on the heated platens 11 of pressing ram 3 and pressing table 2 and on the steel strips 5 and 6.

Since a high pressing force will be transferred to a material to be pressed which is running through the press, the rolling bars 1 are subjected to considerable stress. Consequently, one of the prerequisites for a trouble free operation of the press is that linear displacements of the rolling bars 1 in the pressing area cannot cause destruction of the guide chains 12 and the rolling bars themselves. A prerequisite for not having a linear displacement of the rolling bars 1 in the pressing area which is too large, includes having a precisely orthogonal introduction of the rolling bars 1 in the run-in arc at the tangential transition to the horizontal pressing plane and a trouble free running on the pressing surface.

Figure 2:
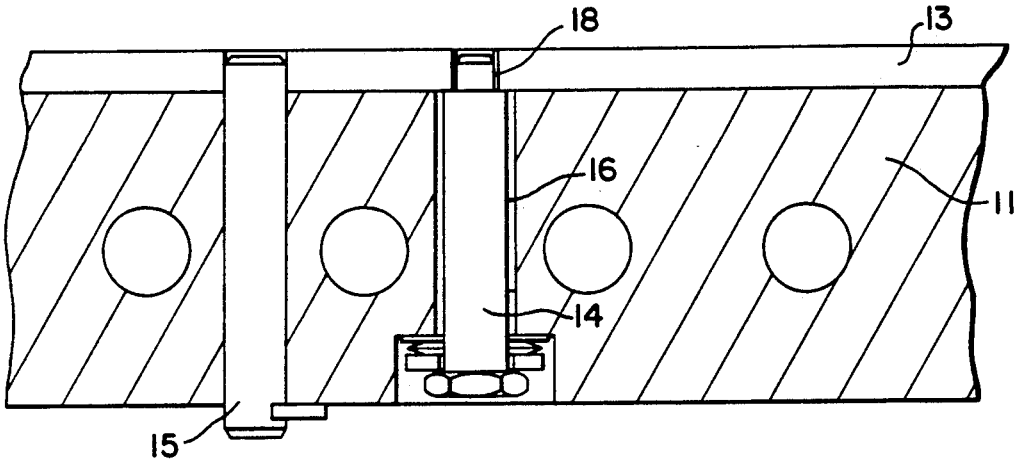
FIG. 2 shows a section of the heat platen and roll platen as viewed through section I—I of FIG. 1.
Figure 3:
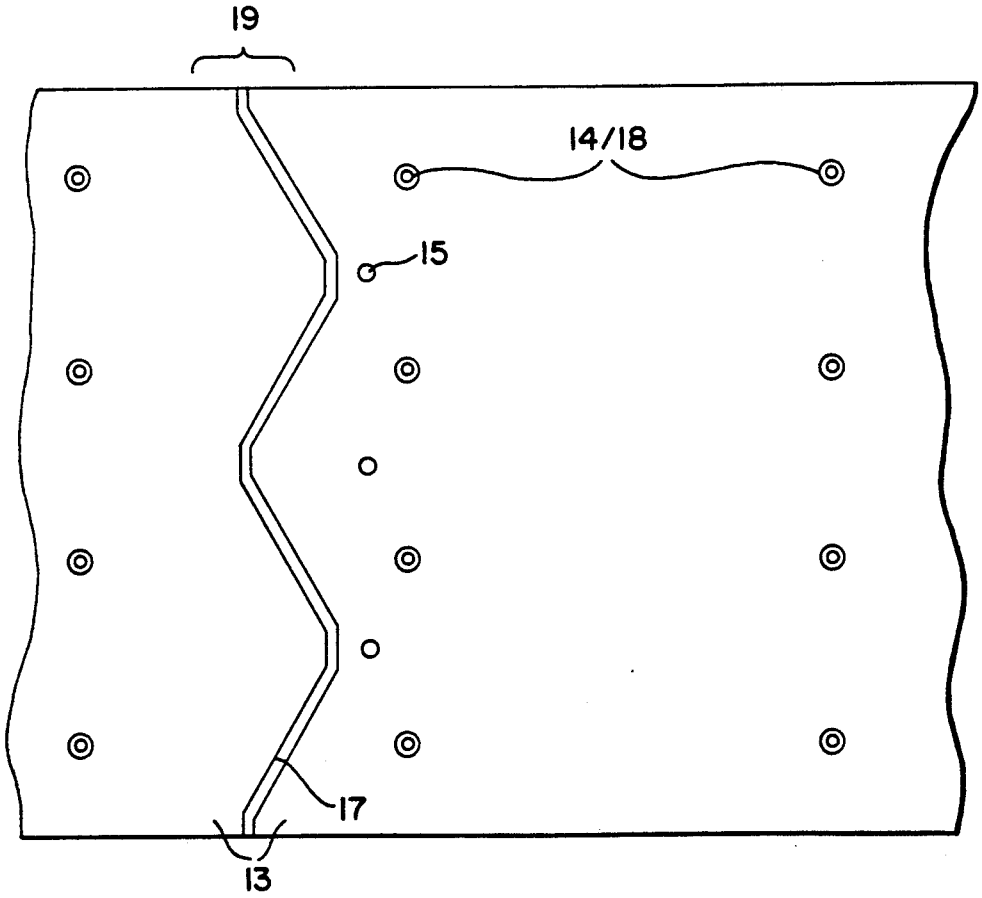
FIG. 3 shows a plan view of two roll platens according to FIG. 2.

FIGS. 2 and 3 show a section I—I from FIG. 1, which illustrates the attachment of the roll platens 13 to the heated platen 11 of the pressing table 2. The roll platens 13 are bolted against the heated platen 11 by means of a screw connection consisting of a screw bolt 14 and a threaded bore 18. Thermal expansion is allowed for by having corresponding bores 16 in the heated platens which have a greater diameter than the screw bolts 14. The threaded bores 18 are located in the roll platens 13. At the end of the platens 13 which is nearer to where the material to be pressed enters, the roll platens 13 are fastened to the heated platens 11 by fixing bolts 15 as a fixed point. The transition from one roll platen 13 to the other are designed as sawtooth connections 19 and may be executed as trapezoidal or round arcs. An expansion joint 17 is provided as compensation to allow for thermal expansion. The bores in the heated platens 11 and roll platens 13 for the screw bolts 14 and fixing bolts 15 are, in this case, arranged in such a way that the roll platens can be turned so that both sides can be used as a running surface for the rolling bars 1. The roll platens can consequently remain in use for longer periods of time and the complete system can continue in operation for longer periods of time without requiring maintenance and repair. The roll platens 13 are dimensioned to allow them to be handled so that a plurality of interchangeable roll platen sections can be installed over the overall length of the heated platens. For example, 7 sections each having a length of 4 m could be used in the case of a heated platen having a length of 28 m.

What is claimed is:

1. A continuously operating press comprising:
a pressing table;
a pressing ram facing said pressing table and defining an adjustable pressing gap therebetween;
first and second flexible endless steel strips which transfer a pressing pressure to and draw a material to be pressed through said adjustable gap;
driving drums and deflecting drums which drive said first and second endless steel strips around said pressing table and said pressing ram, respectively;
rolling bars which support said endless steel strips and which move with said endless steel strips, said rolling bars being disposed with their axes being transverse to the running direction of said steel strips;
heated platens attached to said pressing table and pressing ram, respectively, said rolling bars rolling on said heated platens;
roll platens attached to rolling surfaces of said heated platens, said roll platens
having a thickness in a range of 7 mm to 23 mm and a Brinell hardness of 250, said roll platens being heat treated on opposite surfaces, said roll platen surfaces having a precision ground finish.

2. The continuously operating press as claimed in claim 1, wherein said roll platens have a thickness in the range of 12 to 18 mm.

3. The continuously operating press as claimed in claim 1, further comprising a saw-toothed expansion joint, and wherein a plurality of roll platens are arranged adjacent to each other and separated by said sawtoothed expansion joint.

4. The continuously operating press as claimed in claim 3, further comprising a screw connection which allows for thermal expansion and which anchors said roll platens to said heated platens.

5. The continuously operating press as claimed in claim 4, further comprising fixing bolts which firmly fasten said roll platens to said heated platens as a fixed point, said fixing bolts being located near an end of the roll platens which is nearest to where said material to be pressed enters said adjustable gap.

6. The continuously operating press as claimed in claim further comprising a screw connection which allows for thermal expansion and which anchors said roll platens to said heated platens.

7. The continuously operating press as claimed in claim 1, further comprising fixing bolts which firmly fasten said roll platens to said heated platens as a fixed point, said fixing bolts being located near an end of the roll platens which is nearest to where said material to be pressed enters said adjustable gap.

8. A continuously operating press comprising:
a pressing table;
a pressing ram facing said pressing table and defining an adjustable pressing gap therebetween;
first and second flexible endless steel strips which transfer a pressing pressure to and draw a material to be pressed through said adjustable gap;
driving drums and deflecting drums which drive said first and second endless steel strips around said pressing table and said pressing ram, respectively;
rolling bars which support said endless steel strips and which move with said endless steel strips, said rolling bars being disposed with their axes being transverse to the running direction of said steel strips;

heated platens attached to said pressing table and pressing ram, respectively, said rolling bars rolling on said heated platens;

roll platens attached to rolling surfaces of said heated platens, said roll platens having a thickness in a range of 7 mm to 23 mm and a Brinell hardness of 250, said roll platens being heat treated throughout, said roll platen surfaces having a precision ground finish.

* * * * *